US009041317B2

(12) United States Patent
Yang

(10) Patent No.: US 9,041,317 B2
(45) Date of Patent: May 26, 2015

(54) BALLAST LEAD WIRE CONFIGURATION

(71) Applicant: Kevin Yang, Lomita, CA (US)

(72) Inventor: Kevin Yang, Lomita, CA (US)

( * ) Notice: Subject to any disclaimer, the term of this patent is extended or adjusted under 35 U.S.C. 154(b) by 111 days.

(21) Appl. No.: 14/026,327

(22) Filed: Sep. 13, 2013

(65) Prior Publication Data

US 2015/0077013 A1 Mar. 19, 2015

(51) Int. Cl.
*H05B 37/02* (2006.01)

(52) U.S. Cl.
CPC ..... *H05B 37/02* (2013.01)

(58) Field of Classification Search
USPC ..... 315/178–184, 291, 294, 307, 308, 312
See application file for complete search history.

(56) References Cited

U.S. PATENT DOCUMENTS 5,021,714 A * 6/1991 Swanson et al. ..... 315/101
5,021,717 A * 6/1991 Nilssen ..... 315/324

* cited by examiner

*Primary Examiner* — Jimmy Vu
(74) *Attorney, Agent, or Firm* — Clement Cheng

(57) ABSTRACT

A ballast lead wire configuration includes a ballast having a pair of power inputs and a pair of power outputs. A primary lamp is electrically connected to the ballast. A first primary lamp ballast terminal is formed on the primary lamp and electrically connected to the ballast. A second primary lamp ballast terminal is formed on the primary lamp and electrically connected to the ballast. A second lamp electrically connected to the ballast, and the second lamp is electrically connected to the first lamp in series. A first secondary lamp ballast terminal is formed on the secondary lamp and electrically connected to the ballast. A second secondary lamp ballast terminal is formed on the secondary lamp and electrically connected to the ballast. The first lamp and the second lamp are florescent lamps over 36 inches long.

16 Claims, 5 Drawing Sheets

BALLAST LEAD WIRE CONFIGURATION

FIELD OF THE INVENTION

The present invention is in the field of fluorescent lighting program instant start ballast output lead wire configuration.

DISCUSSION OF RELATED ART

A wide variety of lead wire configurations have been used in fluorescent lighting. Here, the color of the lead wires is standardized according to standard electrical convention. The color of the lead wire signifies the purpose of the lead wire, and is not merely the color of the insulation that is covering the lead wire. The wire is color-coded for purposes of electrical installation by electricians and electrical technicians.

As seen in FIGS. 2, 4 the popular program preheat start ballast output lead wires configuration is shown. They have similar low voltage power to supply their lamps' right filaments. One can see that the two red lead wires and the two blue lead wires also are connected to their right side of each lamp's filament individually. This electrical configuration requires an additional filament power to both ends of the lamps, namely the left side of the lamp as it is indicated with the two yellow lead wires connected. These ballasts would not work properly without the two yellow lead wires.

As seen in FIGS. 3, 5 another ballast/lamp configuration with two lamps are connected to a ballast. The first lamp and the second lamp have no filament circuit because the lamp filaments are completely shorted. Also, both ends of the lamps are directly connected to the ballast. The shorting of the filament is one way to save energy, but this configuration reduces lamp life. FIGS. 2-5 have the number of florescent lamps doubled in configurations shown in FIGS. 7-10.

SUMMARY OF THE INVENTION

A ballast lead wire configuration includes a ballast having a pair of power inputs and a pair of power outputs. A primary lamp is electrically connected to the ballast. A first primary lamp ballast terminal is formed on the primary lamp and electrically connected to the ballast. A second primary lamp ballast terminal is formed on the primary lamp and electrically connected to the ballast. A second lamp electrically connected to the ballast, and the second lamp is electrically connected to the first lamp in series. A first secondary lamp ballast terminal is formed on the secondary lamp and electrically connected to the ballast. A second secondary lamp ballast terminal is formed on the secondary lamp and electrically connected to the ballast. The first lamp and the second lamp are florescent lamps over 36 inches long. The ballast lead wire configuration pair of power outputs of the ballast further include a first primary terminal; a second primary terminal; a first secondary terminal; and a second secondary terminal.

The first primary terminal is connected to the first primary connector line. The second primary terminal is connected to a second primary connector line. The first secondary terminal is connected to a first secondary connector line. The second secondary terminal is connected to a second secondary connector line. The first secondary connector line is connected to the first secondary lamp ballast terminal. The secondary lamp ballast terminal receives the second secondary connector line. The first primary lamp ballast terminal receives the first primary connector line. The second primary lamp ballast terminal receives the second primary connector line. The primary lamp and a secondary lamp comprise a pair of lamps that are connected to each other at a total of four lamp terminals, which include a first primary lamp terminal formed on the primary lamp, a second primary lamp terminal formed on the primary lamp, a first secondary lamp terminal formed on the secondary lamp, and a second secondary lamp terminal formed on the secondary lamp. The second primary lamp terminal is electrically connected to the first secondary lamp terminal through a first connector line. The first primary lamp terminal is electrically connected to the second secondary lamp terminal through a second connector line.

The ballast lead wire configuration may also have a tertiary lamp connected to the ballast and a quaternary lamp connected to the ballast. The third lamp and the fourth lamp are powered simultaneously with the first lamp and the second lamp. The tertiary lamp is connected in series to the quaternary lamp. A filament is preferably located within the primary lamp and the secondary lamp. The lamp is preferably a tubular lamp of T8 or T5 construction. The ballast outputs a low-voltage of between 3 VAC to 5 VAC.

There is no direct electrical connection between the ballast and the first primary lamp terminal, the second primary lamp terminal, the first secondary lamp terminal, or the second secondary lamp terminal. The pair of power outputs passes across a pair of filaments, namely a first filament and a second filament. The ballast outputs a low-voltage of between 3 VAC to 5 VAC across each of the pair of filaments.

Figure 1:
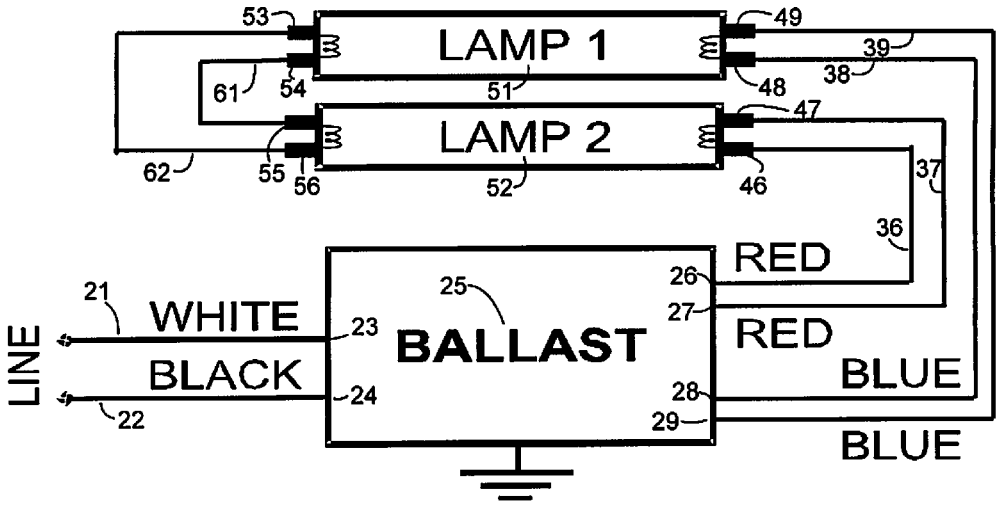
FIG. 1 is a diagram of the present invention.
Figure 2:
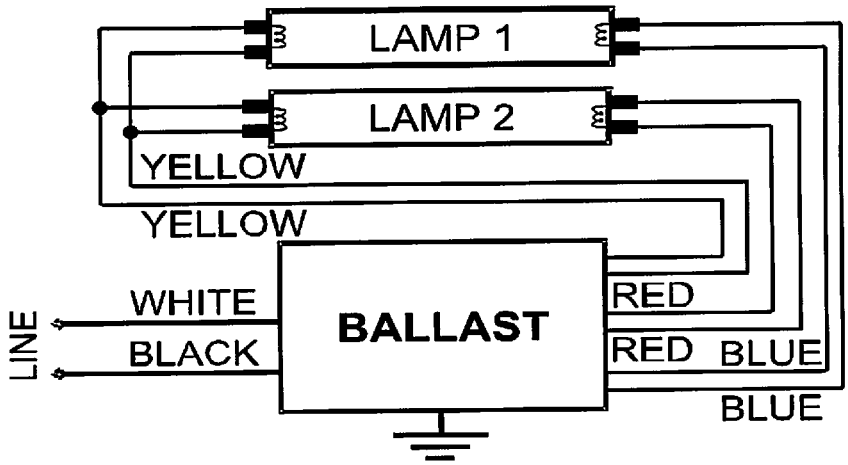
Fig. 2 (Prior Art)
FIG. 2 is a diagram of a prior art program preheat start ballast output lead wire configuration.
Figure 3:
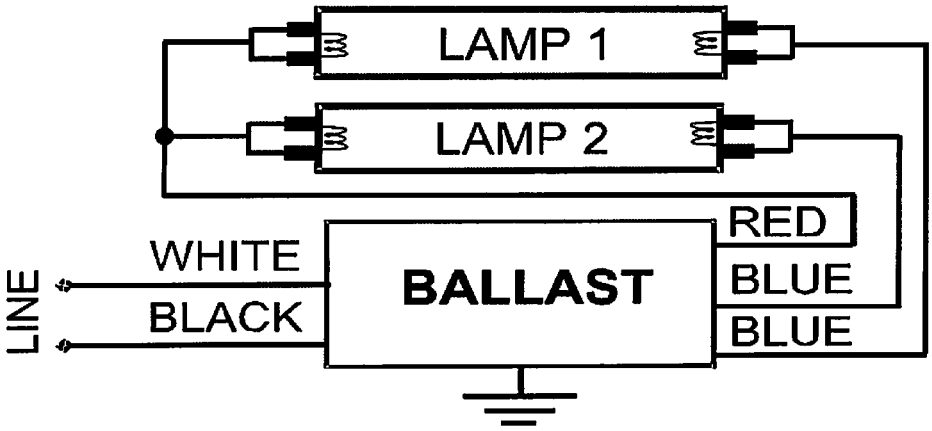
Fig. 3 (Prior Art)
FIG. 3 is a diagram of a prior art ballast output lead wire configuration having a pair of lamps without powered filaments.
Figure 4:
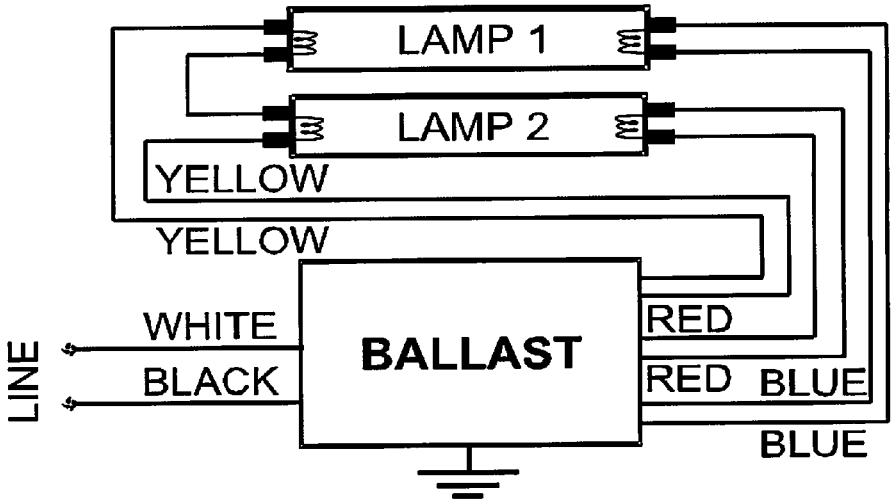
Fig. 4 (Prior Art)
FIG. 4 is a diagram of a prior art program preheat start ballast output lead wire configuration.
Figure 5:
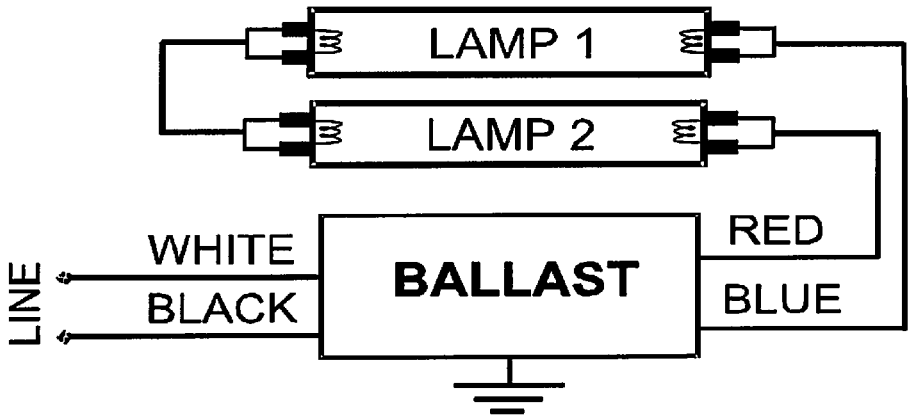
Fig. 5 (Prior Art)
FIG. 5 is a diagram of a prior art ballast output lead wire configuration having a pair of lamps without powered filaments.

The following call out list of elements can be a useful guide in referencing the element numbers of the drawings.

21 Neutral Power Line
22 Hot Power Line
23 Neutral Power Line Connection
24 Hot Power Line Connection
25 Ballast
26 First Secondary Terminal
27 Second Secondary Terminal
28 First Primary Terminal
29 Second Primary Terminal
36 First Secondary Connector Line
37 Second Secondary Connector Line
38 First Primary Connector Line
39 Second Primary Connector Line
46 First Secondary Lamp Ballast Terminal
47 Second Secondary Lamp Ballast Terminal
48 First Primary Lamp Ballast Terminal

49 Secondary Primary Lamp Ballast Terminal
51 Primary Lamp
52 Secondary Lamp
53 First Primary Lamp Terminal
54 Second Primary Lamp Terminal
55 First Secondary Lamp Terminal
56 Second Secondary Lamp Terminal
61 First Connector Line
62 Second Connector Line

DETAILED DESCRIPTION OF THE PREFERRED EMBODIMENT

The present invention is a fluorescent lighting program instant start ballast output lead wire configuration that supplies two separate low voltage of about 3-5 V powering one side of each lamp filament. It uses two red lead wires as one of the power lines to connect the second lamp right side filament, and uses two blue lead wires as supplemental power to supply the first lamp right side filament. Both lamp filaments on the other side between the lamps are shown as the lamp left side which must be shorted and connected together. This raises a variety of different stability issues that are compensated using a control algorithm located in the ballast. The ballast has a processor that may need to quickly process various multi-variable differential equations to maintain stability of the system. The stability power supply algorithm is programmed into the control algorithm in the ballast.

The key feature of the present invention is that a pair of fluorescent lamps, namely a first lamp 51 and a second lamp 52 can be connected by a first connector line 61 and a second connector line 62.

The ballast is powered by a pair of power lines. The invention generally features a neutral power line 21 that is typically a white copper wire and a hot power line 22 that is typically a black copper wire. The power lines connect to the ballast. The neutral power line connects to the neutral power line connection 23 on the ballast 25. The hot power line connects to the hot power line connection 24 on the ballast 25. The ballast has various output terminals. The ballast output terminals include a first primary terminal 28, a second primary terminal 29, a first secondary terminal 26, and a second secondary terminal 27.

The first primary terminal 28 is connected to the first primary connector line 38. The second primary terminal 29 is connected to the second primary connector line 39. The first secondary terminal 26 is connected to the first secondary connector line 36. The second secondary terminal 27 is connected to the second secondary connector line 37.

The first secondary connector line 36 is connected to the first secondary lamp ballast terminal 46. The secondary lamp ballast terminal 47 receives the second secondary connector line 37. The first primary lamp ballast terminal 48 receives the first primary connector line 38. The second primary lamp ballast terminal 49 receives the second primary connector line 39.

A pair of lamps are connected to the ballast. The primary lamp 51 and the secondary lamp 52 both have a pair of ballast terminals that are connected to the ballast. The primary lamp 51 has a first primary lamp ballast terminal 48 and a second primary lamp ballast terminal 49. The secondary lamp 52 has a first secondary lamp ballast terminal 47 and a second secondary lamp ballast terminal 48. The pair of lamps have a total of four ballast terminals.

The pair of lamps are connected to each other at a total of four lamp terminals. Each lamp is connected to the other. The primary lamp has a first primary lamp terminal 53 and a second primary lamp terminal 54. The secondary lamp has a first secondary lamp terminal 55 and a second secondary lamp terminal 56.

The second primary lamp terminal 54 is electrically connected to the first secondary lamp terminal 55 through a first connector line 61. The first primary lamp terminal 53 is electrically connected to the second secondary lamp terminal 56 through a second connector line 62.

The lamp terminals have similar construction with the ballast terminals. A filament preferably connects between opposite ends of the lamp. The lamp is tubular and preferably of T8 or T5 construction. The connector lines are preferably insulated copper wiring. The lamp terminals are connectors that connect the lamp to the copper wiring of the connector lines.

Figure 6:
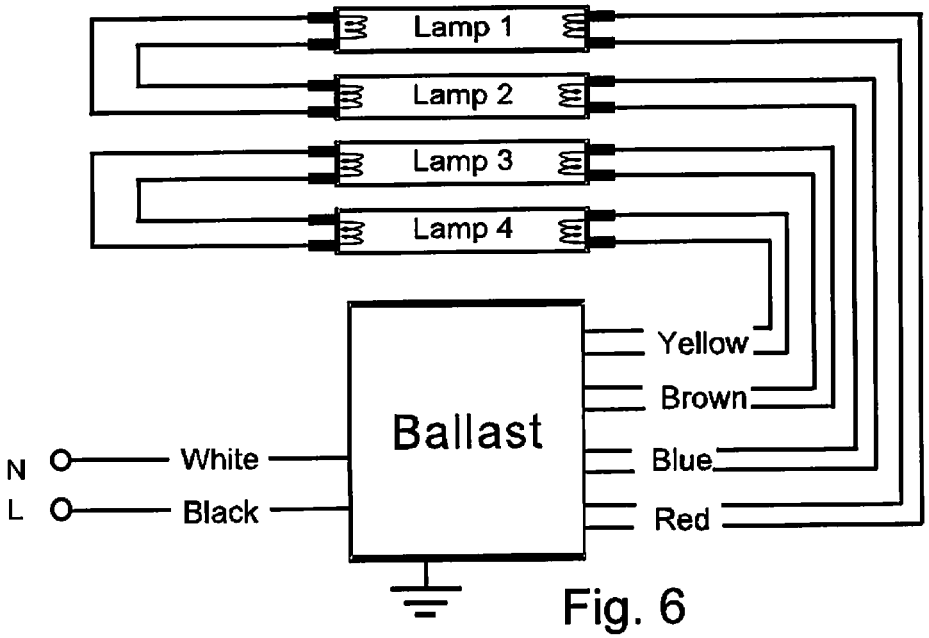
FIG. 6 is a diagram of the first figure configuration with double the number of lamps.
Figure 7:
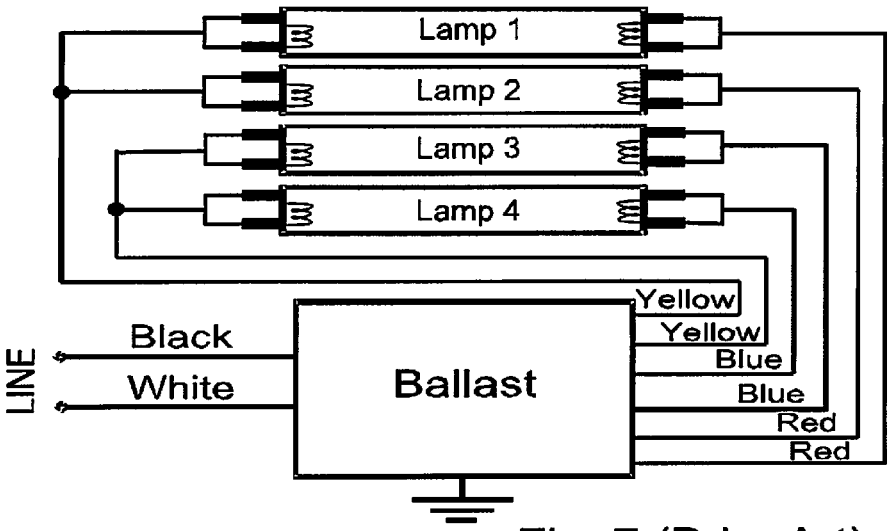
Fig. 7 (Prior Art)
FIG. 7 is a diagram of the second figure configuration with double the number of lamps.
Figure 8:
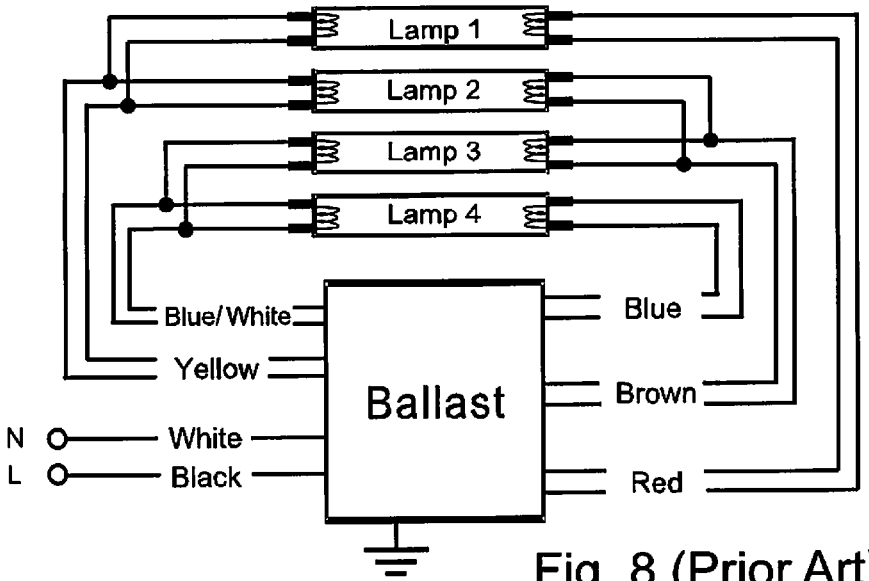
Fig. 8 (Prior Art)
FIG. 8 is a diagram of the third figure configuration with double the number of lamps.
Figure 9:
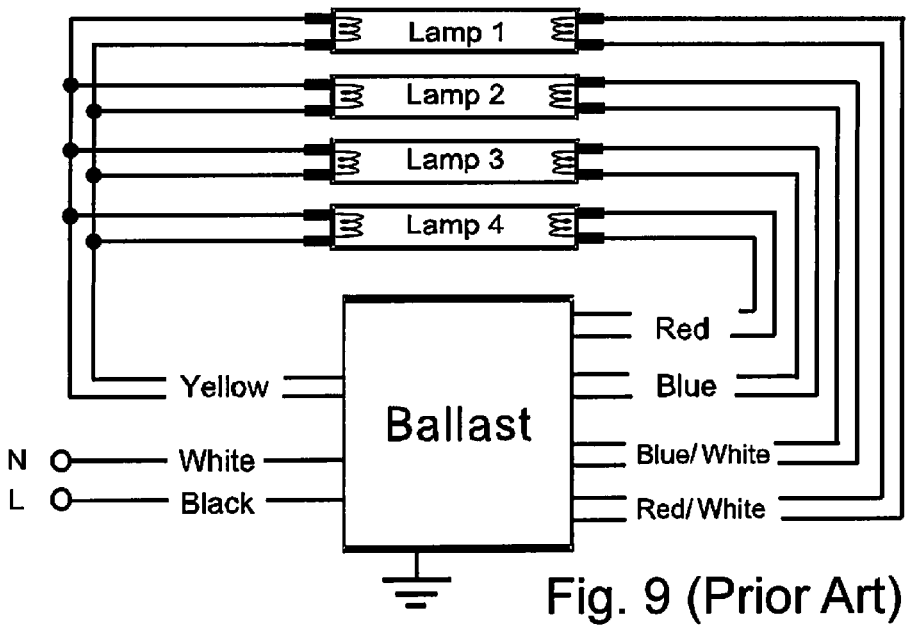
Fig. 9 (Prior Art)
FIG. 9 is a diagram of the fourth figure configuration with double the number of lamps.
Figure 10:
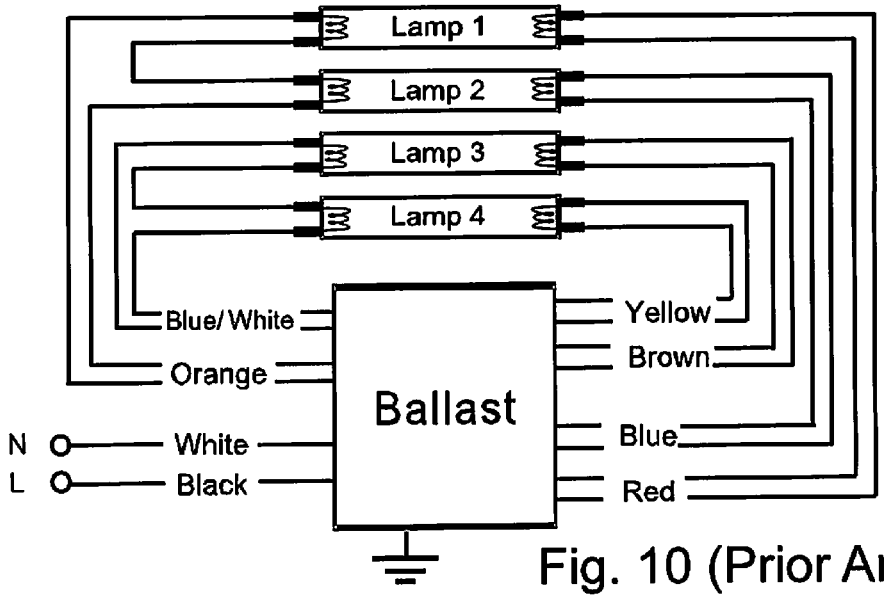
Fig. 10 (Prior Art)
FIG. 10 is a diagram of the fifth figure configuration with double the number of lamps.

As seen in FIG. 6, the present invention only works for a ballast to drive an even number of tube lamps, such as two lamps, four lamps, six lamps and so on. This invention is for T5 and T8 tube lamps with the lamp length at 36" or longer.

The ballast has a pair of power inputs and a pair of power outputs. The pair of power outputs passes across a pair of filaments, namely a first filament and a second filament. The first filament is across a pair of blue wires and the second filament is across a pair of red wires. The ballast outputs a low-voltage of between 3 VAC to 5 VAC between the two red wires which is the first secondary terminal 26 and the second secondary terminal 27. The ballast also outputs a low-voltage of about 3 VAC to 5 VAC between the two blue wires which is between first primary terminal 28 and second primary terminal 29. The ballast provides a low voltage of between about 3 VAC to 5 VAC across the filament. Between the pair of primary terminals and the pair of secondary terminals, the voltage difference is higher of approximately 100 to 200 V AC. Preferably, the alternating current is a sine wave output.

There is no direct electrical connection between the ballast and the first primary lamp terminal 53, the second primary lamp terminal 54, the first secondary lamp terminal 55, or the second secondary lamp terminal 56. The first connector line 61 is not directly connected to the ballast.

The second connector line 62 is not directly connected to the ballast. The far left ends of the first and second lamp are only connected to each other.

The following claims define the scope of the invention.

The invention claimed is:

1. A ballast lead wire configuration comprising:

a. a ballast having a pair of power inputs and a pair of power outputs;

b. a primary lamp electrically connected to the ballast;

c. a first primary lamp ballast terminal formed on the primary lamp and electrically connected to the ballast;

d. a second primary lamp ballast terminal formed on the primary lamp and electrically connected to the ballast;

e. a second lamp electrically connected to the ballast, wherein the second lamp is electrically connected to the first lamp in series;

f. a first secondary lamp ballast terminal formed on the secondary lamp and electrically connected to the ballast; and g. a second secondary lamp ballast terminal formed on the secondary lamp and electrically connected to the ballast, wherein the primary lamp and the secondary lamp are fluorescent lamps over 36 inches long.

2. The ballast lead wire configuration of claim 1, wherein the pair of power outputs of the ballast further comprise:

a. a first primary terminal;

b. a second primary terminal;

c. a first secondary terminal; and d. a second secondary terminal, wherein the first primary terminal is connected to the a first primary connector line, wherein the second primary terminal is connected to a second primary connector line, wherein the first secondary terminal is connected to a first secondary connector line, wherein the second secondary terminal is connected to a second secondary connector line, wherein the first secondary connector line is connected to the first secondary lamp ballast terminal, wherein the secondary lamp ballast terminal receives the second secondary connector line, wherein the first primary lamp ballast terminal receives the first primary connector line, wherein the second primary lamp ballast terminal receives the second primary connector line.

3. The ballast lead wire configuration of claim 2, wherein the primary lamp and a secondary lamp comprise a pair of lamps that are connected to each other at a total of four lamp terminals, and further comprising:

a. a first primary lamp terminal formed on the primary lamp;

b. a second primary lamp terminal formed on the primary lamp;

c. a first secondary lamp terminal formed on the secondary lamp; and d. a second secondary lamp terminal formed on the secondary lamp, wherein the second primary lamp terminal is electrically connected to the first secondary lamp terminal through a first connector line, and wherein the first primary lamp terminal is electrically connected to the second secondary lamp terminal through a second connector line.

4. The ballast lead wire configuration of claim 3, further comprising:

a. a tertiary lamp, wherein the tertiary lamp is connected to the ballast;

b. a quaternary lamp, wherein the quaternary lamp is connected to the ballast and wherein the tertiary lamp is connected in series to the quaternary lamp.

5. The ballast lead wire configuration of claim 3, further comprising: a filament within the primary lamp and the secondary lamp.

6. The ballast lead wire configuration of claim 3, wherein the lamp is tubular of T8 or T5 construction.

7. The ballast lead wire configuration of claim 1, wherein the primary lamp and a secondary lamp comprise a pair of lamps that are connected to each other at a total of four lamp terminals, and further comprising:

a. a first primary lamp terminal formed on the primary lamp;

b. a second primary lamp terminal formed on the primary lamp;

c. a first secondary lamp terminal formed on the secondary lamp; and d. a second secondary lamp terminal formed on the secondary lamp, wherein the second primary lamp terminal is electrically connected to the first secondary lamp terminal through a first connector line, and wherein the first primary lamp terminal is electrically connected to the second secondary lamp terminal through a second connector line.

8. The ballast lead wire configuration of claim 7, further comprising:

a. a tertiary lamp, wherein the tertiary lamp is connected to the ballast;

b. a quaternary lamp, wherein the quaternary lamp is connected to the ballast and wherein the tertiary lamp is connected in series to the quaternary lamp.

9. The ballast lead wire configuration of claim 7, further comprising: a filament within the primary lamp and the secondary lamp.

10. The ballast lead wire configuration of claim 7, wherein the lamp is tubular of T8 or T5 construction.

11. The ballast lead wire configuration of claim 7, wherein the ballast outputs a low-voltage of between 3 VAC to 5 VAC.

12. A ballast lead wire configuration comprising:

a. a ballast having a pair of power inputs and a pair of power outputs;

b. a primary lamp electrically connected to the ballast;

c. a first primary lamp ballast terminal formed on the primary lamp and electrically connected to the ballast;

d. a second primary lamp ballast terminal formed on the primary lamp and electrically connected to the ballast;

e. a second lamp electrically connected to the ballast, wherein the second lamp is electrically connected to the first lamp in series;

f. a first secondary lamp ballast terminal formed on the secondary lamp and electrically connected to the ballast; and g. a second secondary lamp ballast terminal formed on the secondary lamp and electrically connected to the ballast, wherein the primary lamp and the secondary lamp are fluorescent lamps.

13. The ballast lead wire configuration of claim 12, wherein the pair of power outputs of the ballast further comprise:

a. a first primary terminal;

b. a second primary terminal;

c. a first secondary terminal; and d. a second secondary terminal, wherein the first primary terminal is connected to the a first primary connector line, wherein the second primary terminal is connected to a second primary connector line, wherein the first secondary terminal is connected to a first secondary connector line, wherein the second secondary terminal is connected to a second secondary connector line, wherein the first secondary connector line is connected to the first secondary lamp ballast terminal, wherein the secondary lamp ballast terminal receives the second secondary connector line, wherein the first primary lamp ballast terminal receives the first primary connector line, wherein the second primary lamp ballast terminal receives the second primary connector line.

14. The ballast lead wire configuration of claim 13, wherein the primary lamp and a secondary lamp comprise a pair of lamps that are connected to each other at a total of four lamp terminals, and further comprising:

a. a first primary lamp terminal formed on the primary lamp;

b. a second primary lamp terminal formed on the primary lamp;

c. a first secondary lamp terminal formed on the secondary lamp; and d. a second secondary lamp terminal formed on the secondary lamp, wherein the second primary lamp terminal is electrically connected to the first secondary lamp terminal through a first connector line, and wherein the first primary lamp terminal is electrically connected to the second secondary lamp terminal through a second connector line.

15. The ballast lead wire configuration of claim 14, further comprising:

a. a tertiary lamp, wherein the tertiary lamp is connected to the ballast;

b. a quaternary lamp, wherein the quaternary lamp is connected to the ballast and wherein the tertiary lamp is connected in series to the quaternary lamp.

16. The ballast lead wire configuration of claim 1, wherein the pair of power outputs of the ballast further comprise:

a. a first primary terminal;

b. a second primary terminal;

c. a first secondary terminal; and d. a second secondary terminal, wherein the first primary terminal is connected to the a first primary connector line, wherein the second primary terminal is connected to a second primary connector line, wherein the first secondary terminal is connected to a first secondary connector line, wherein the second secondary terminal is connected to a second secondary connector line, wherein the first secondary connector line is connected to the first secondary lamp ballast terminal, wherein the secondary lamp ballast terminal receives the second secondary connector line, wherein the first primary lamp ballast terminal receives the first primary connector line, wherein the second primary lamp ballast terminal receives the second primary connector line, wherein there is no direct electrical connection between the ballast and the first primary lamp terminal, the second primary lamp terminal, the first secondary lamp terminal, or the second secondary lamp terminal, wherein the pair of power outputs passes across a pair of filaments, namely a first filament and a second filament, wherein the ballast outputs a low-voltage of between 3 VAC to 5 VAC across each of the pair of filaments.

* * * * *